United States Patent [19]

Modra et al.

[11] 4,102,109

[45] Jul. 25, 1978

[54] PRESS

[76] Inventors: Theodor Victor Modrá, Thistle Island; Norman Wills Growden, Wedge Island, both of Port Lincoln, Australia

[21] Appl. No.: 786,966

[22] Filed: Apr. 13, 1977

[30] Foreign Application Priority Data

Apr. 13, 1976 [AU] Australia ..... 5575/76

[51] Int. Cl.[2] ..... B65B 1/24; B65B 63/02

[52] U.S. Cl. ..... 53/24; 53/124 D; 53/124 E; 100/3; 100/176; 100/177; 100/229 A

[58] Field of Search ..... 53/24, 124 D, 124 E; 100/3, 41, 176, 177, 229 A, 233

[56] References Cited

U.S. PATENT DOCUMENTS

| | | | |
|---|---|---|---|
| 3,029,723 | 4/1962 | Schweer | 100/176 |
| 3,880,072 | 4/1975 | Ord | 100/229 AX |
| 3,881,407 | 5/1975 | Goar | 100/229 AX |
| 3,889,588 | 6/1975 | Wollersheim | 100/177 |

*Primary Examiner*—Travis S. McGehee
*Attorney, Agent, or Firm*—Jay L. Chaskin

[57] ABSTRACT

A wool press having a receptacle and means at the mouth of the receptacle for forcing wool at high pressure through the mouth into the receptacle so as to form a bale therein, the mouth being relatively narrow so that notwithstanding high pressure of wool contained in the receptacle the wool does not disgorge from the mouth.

7 Claims, 12 Drawing Figures

PRESS

This invention relates to a wool press for the pressing of wool into a bale.

BACKGROUND OF THE INVENTION

At the present time the method most commonly used to press wool is to insert a bale bag into a press, the bale bag having four flaps which hang down on respective sides of the press, inserting the wool into the bale bag, and as the bale becomes filled with wool, to lower a "monkey" into the press to press the wool downwardly. The monkey is lowered several times during the filling of the bale, and the pressed wool is pinned by means of pins which extend through the walls of the bale. The pressure frequently used is about 12 lbs. per square inch when applied to the wool, resulting in a density in the bale of about 18 lbs. per cubic foot.

The bales are subsequently pressed to a higher density in a factory, in presses called "dumping presses" to a density of between 25 and 30 lbs. per cubic foot. Certain recently introduced presses are capable of achieving a density of 37 lbs. per cubic foot, but these are very high pressure presses and very costly. It is known that wool which has been subject to high pressure has a slight increase in strength, although the reasons for this are not completely understood.

One of the objects of this invention is to provide an improved press which is capable of achieving a relatively high density, thereby enabling the required weight to be packed into a bale on the farm at a high enough pressure that further dumping is not required.

We have found that wool does not behave as a semi-fluid, but that if wool is firstly pressed at relatively low pressure into a bale, subsequent dumping is unlikely to increase density above that 35 lbs. per cubic foot, owing to the failure of the wool to evenly distribute the pressures applied. We have found also that under relatively high pressure, that is pressure above 30 lbs. per square inch, the lanolin content of the wool causes the fibres to move relatively freely, and that it becomes possible to achieve a relatively high density. However we have also found that the high density requires not merely the application of high pressure, but also the application of high pressure to a relatively narrow strip of wool, considerably narrower than the width of the bale.

BRIEF SUMMARY OF THE INVENTION

Briefly in this invention a wool press is provided with a receptacle the walls of which form a bale forming space, and the receptacle is provided with a relatively narrow mouth. The wool is pressed under high pressure (that is under pressure exceeding 30 p.s.i.) through the mouth and into the receptacle to form a bale, and the bale is surrounded with bale-retaining means, for example metal straps.

More specifically, in one aspect of this invention a wool press comprises walls which surround a bale-forming space and spaced apart surfaces which define between them a mouth to said space, the maximum mouth width in a direction perpendicular to a said surface being less than the maximum bale-forming space width between said walls in the same direction, the maximum mouth width being sufficiently small that wool when in said space at superatmospheric pressure does not disgorge from the mouth.

In a further aspect, a method according to this invention of pressing wool into a bale in a wool press having walls which surround a bale-forming space, and spaced apart surfaces which define between them a mouth to said space, the maximum mouth width in a direction perpendicular to a said surface being less than the maximum bale space width between said walls in the same direction, the maximum mouth width being sufficiently small that wool when in said space at superatmospheric pressure does not disgorge from the mouth, the method comprising injecting wool through said mouth under high pressure into said space, discontinuing said wool injection when a bale has been formed therein, surrounding the bale with bale retaining means, and removing the bale from said space.

With this invention it is frequently unnecessary to utilise a jute or plastic bag, and metal bands or wires are all that are required to surround a bale and retain it in the form which it occupies after emerging from a press. If the pressure applied is sufficient, the lanolin content will be caused to flow and upon release of pressure, the bale shape will be retained. This is an important advantage for transport purposes. Furthermore the wool fibre has a slight increase in strength.

In general, we have found that the high pressure injection of wool into a bale can be achieved with rollers or with pushers, and indications at this time are that pushers are capable of applying higher pressure and therefore achieving higher densities than rollers, although of course more mechanism is required.

BRIEF DESCRIPTION OF THE DRAWINGS

Three embodiments of the invention are described hereunder in some detail with reference to and are illustrated in the accompanying drawings in which.

Figures 1, 2, 3:
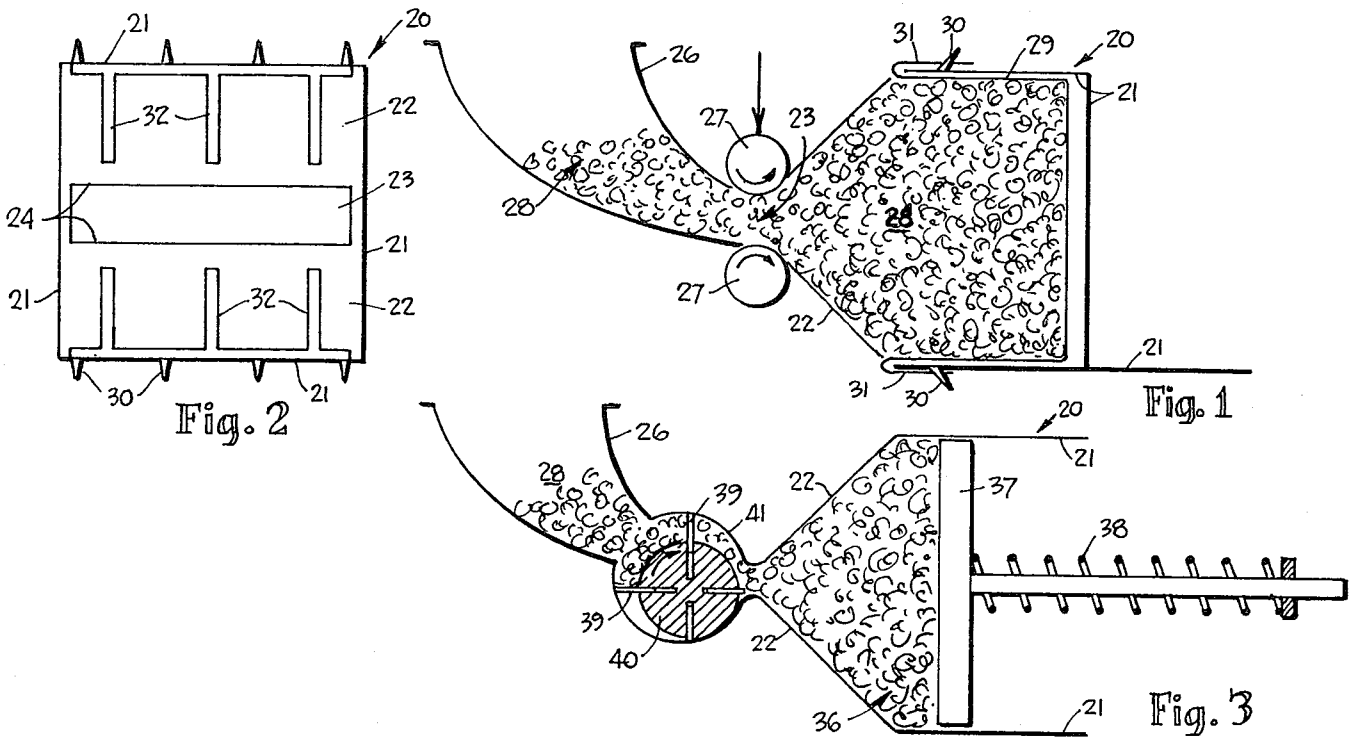
FIG. 1 is a diagrammatic representation of wool being injected into a jute-type bag to form a bale by passing the wool between driven co-operable rollers.
FIG. 2 is a front view of the wool press of FIG. 1 (again represented in diagrammatic form) but with the rollers removed.
FIG. 3 is a diagrammatic section of a wool press according to a second embodiment where a pump-type mechanism is utilised for injection of wool into a wool press.

Referring first to the embodiment of FIGS. 1 and 2, a wool press is generally designated 20 and is provided with five walls 21 which are at right angles to one another and which form between them a bale-formin space. Forwardly of the walls there are two sloping walls designated 22, the walls 22 diverging rearwardly away from a mouth 23 at the front of the press, the mouth 23 being formed by two spaced apart parallel surfaces 24 which are parallel also to two of the walls 21. It will be noted from FIG. 2 that the space between the mouth defining surfaces 24 is very much narrower than the space between the upper and lower bale-forming walls 21 (measured in the same direction) and in practice this space is maintained to less than two inches so that wool within the bale will not disgorge from the mouth even though that wool is contained within the bale at quite high pressure.

In front of the wool press 20 there is provided a chute 26 (shown only in FIG. 1) which directs wool downwardly between the co-operable driven rollers 27 which extend across the mouth 23, and which between them press wool 28 to a relatively high pressure (above 30 p.s.i.) and thereafter the wool is urged into a jute bag 29 contained between the bale-forming walls 21 of the wool press. The jute bag 29 is provided with upper and lower spikes 30 which retain flaps 31 of the jute bag 29. The sloping walls 22 contain slots 32 for receiving bands (not shown) for surrounding the bale and retaining it in a cohesive form. However it should be pointed out for bands to be inserted it is necessary for the co-operable rollers 27 to reverse in direction for a short while so as to draw out sufficient of the wool 28 from the space between the sloping walls 22 to enable the flaps 31 to be closed in and the bands to be inserted through the slots 32 and around the bale.

In the second embodiment illustrated in FIG. 3 in diagrammatic form, wool 28 is fed again between sloping walls 22 into a bale-forming space designated 36 and defined again by bale-forming walls 21 as in the first embodiment. However in the second embodiment there is provided a plunger 37 urged forwardly by a spring 38 which must be depressed by the wool 28 as it enters the bale-forming space. In this embodiment use is not made of any jute bag, and instead of there being two co-operable rollers, use is made of rotating vanes 39 carried in radial slots in a rotor 40, the vanes 39 picking up wool 28 from the chute 26 and forcing that wool into the bale-forming space. The vanes 39 co-operate with a cylindrical stator 41 which reduces the volume of wool 28 drawn inwardly from the chute 26, once again compressing the wool to pressures above 30 p.s.i. such that the lanolin in the wool is caused to flow and the wool is compressed as it enters the bale-forming space.

Figure 4:
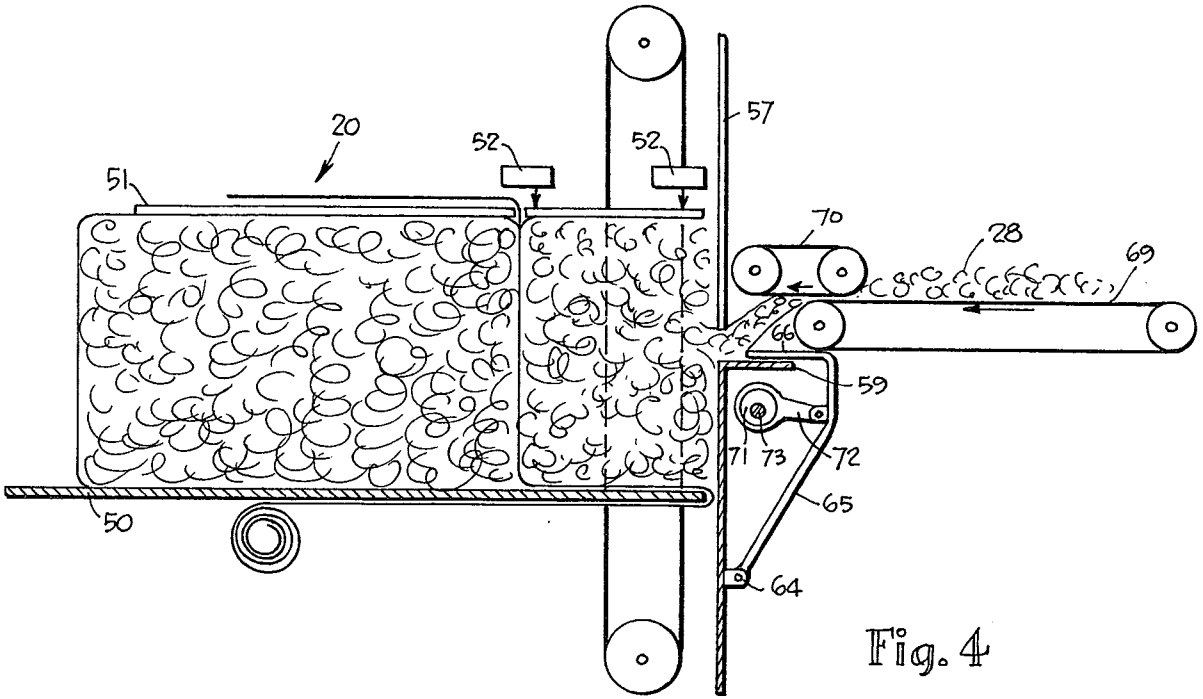
FIG. 4 is a diagrammatic section of a third embodiment wherein wool is injected by means of a plurality of pusher arms into a wool press.
Figure 10:
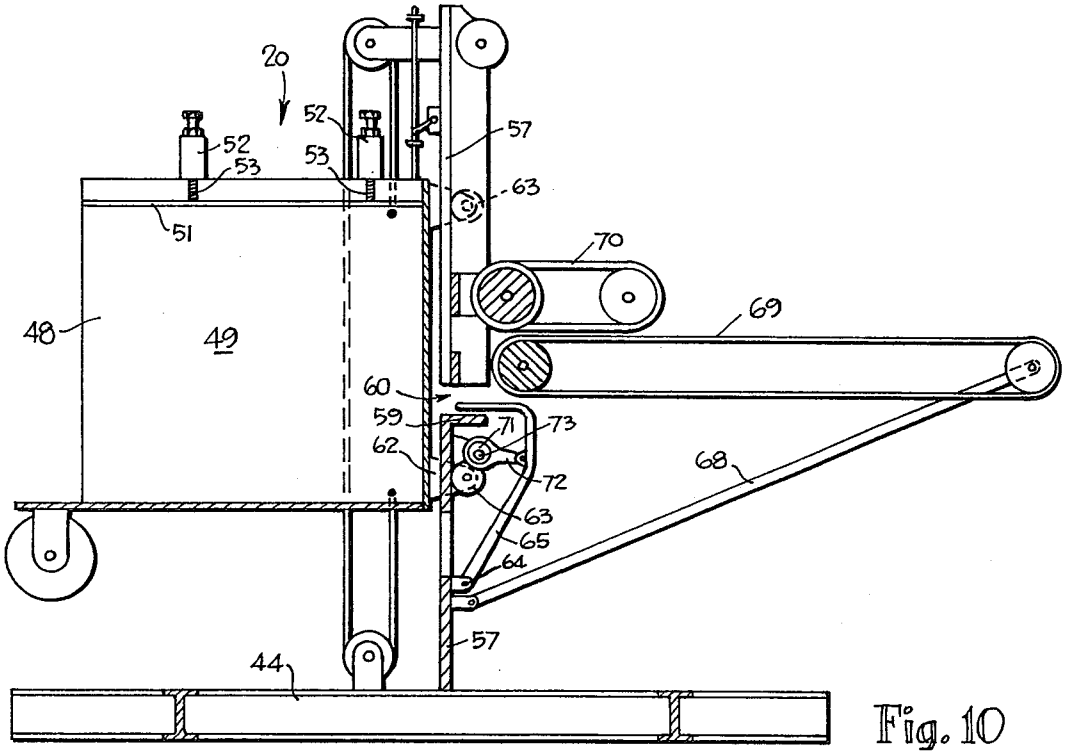
FIG. 10 is a section through a wool press which is diagrammatically illustrated in FIG. 4.
Figure 11:
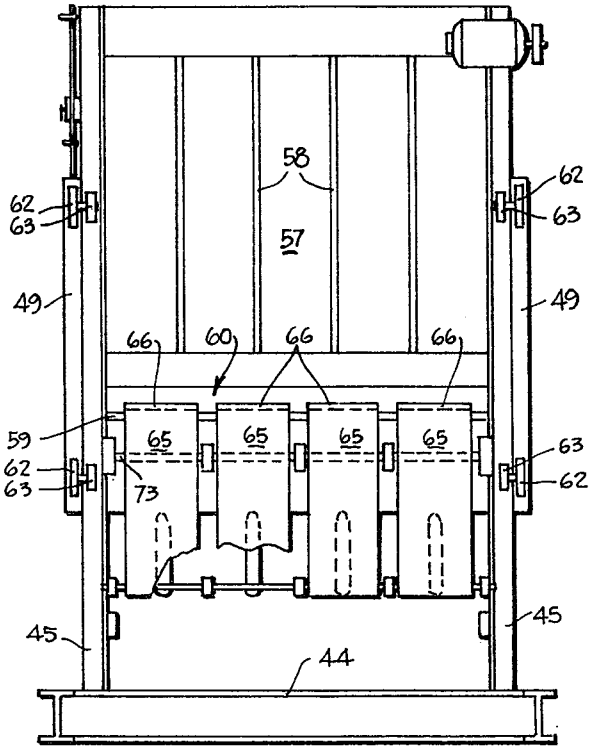
FIG. 11 is a front elevation of FIG. 10 but with the loading mechanism removed.
Figure 12:
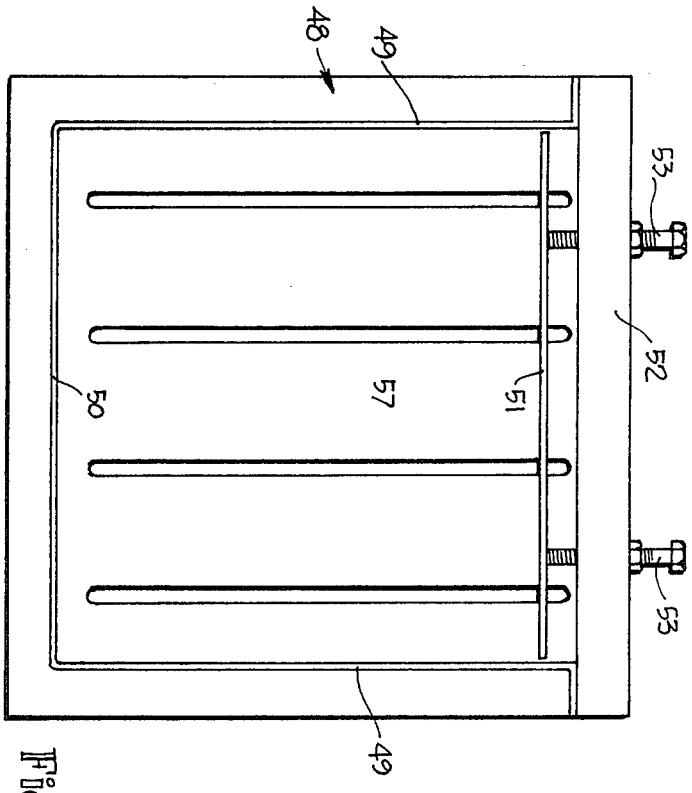
FIG. 12 is a rear elevation of the wool press bale-forming receptacle.

The third embodiment described herein is illustrated diagrammatically in FIGS. 4 through to 9, and is further illustrated in greater detail in FIGS. 10, 11 and 12. In this embodiment a wool press 20 comprises a base frame 44 having on it two upstanding posts 45 the surfaces of which function as tracks.

A bale-forming receptacle 48 comprises side walls 49, a lower wall 50, and an upper wall 51. The upper wall 51 is coupled to some crossbars 52 by means of pressure bolts 53 adjustment of which regulates the pressure applied to side walls of a bale 54 when formed in the receptacle. There is no front wall to the receptacle 49, the front wall howeve being constituted by a wall 57 the upper portion of which contains slots 58 which extend vertically. The lower portion of wall 57 terminates at its upper end in a shelf 59, an upper surface of which co-operates with a lower surface of the upper portion of wall 57 to form a mouth designated 60 from outside to within the receptacle 48.

The walls 49 of receptacle 48 have on them forwardly extending lugs 62 with wheels 63 (shown dotted in FIG. 10) and these engage the track surfaces of the upstanding post 45.

Beneath the shelf 59 and attached to the lower portion of wall 57 are lugs 64 to which the lower end of inverted L-shaped pushers designated 65 are pivoted. Each pusher 65 has a substantially horizontal portion 66 which co-operates with the shelf 59 so that wool deposited on the shelf is pushed by the front end of the horizontal portion 66 through the mouth 50 and into the receptacle 48.

Partly to facilitate loading, and partly to eliminate any safety hazards which might otherwise exist, a front outrigger frame 68 supports a lower driven belt 69 which cooperates with an upper driven belt 70 to take wool 28 deposited on the upper portion of the belt 69 and feed it towards the mouth 60 where it is compressed by the pusher 66 to a high pressure exceeding 30 p.s.i. before entering the receptacle 48.

Figures 5, 6, 7, 8, 9:
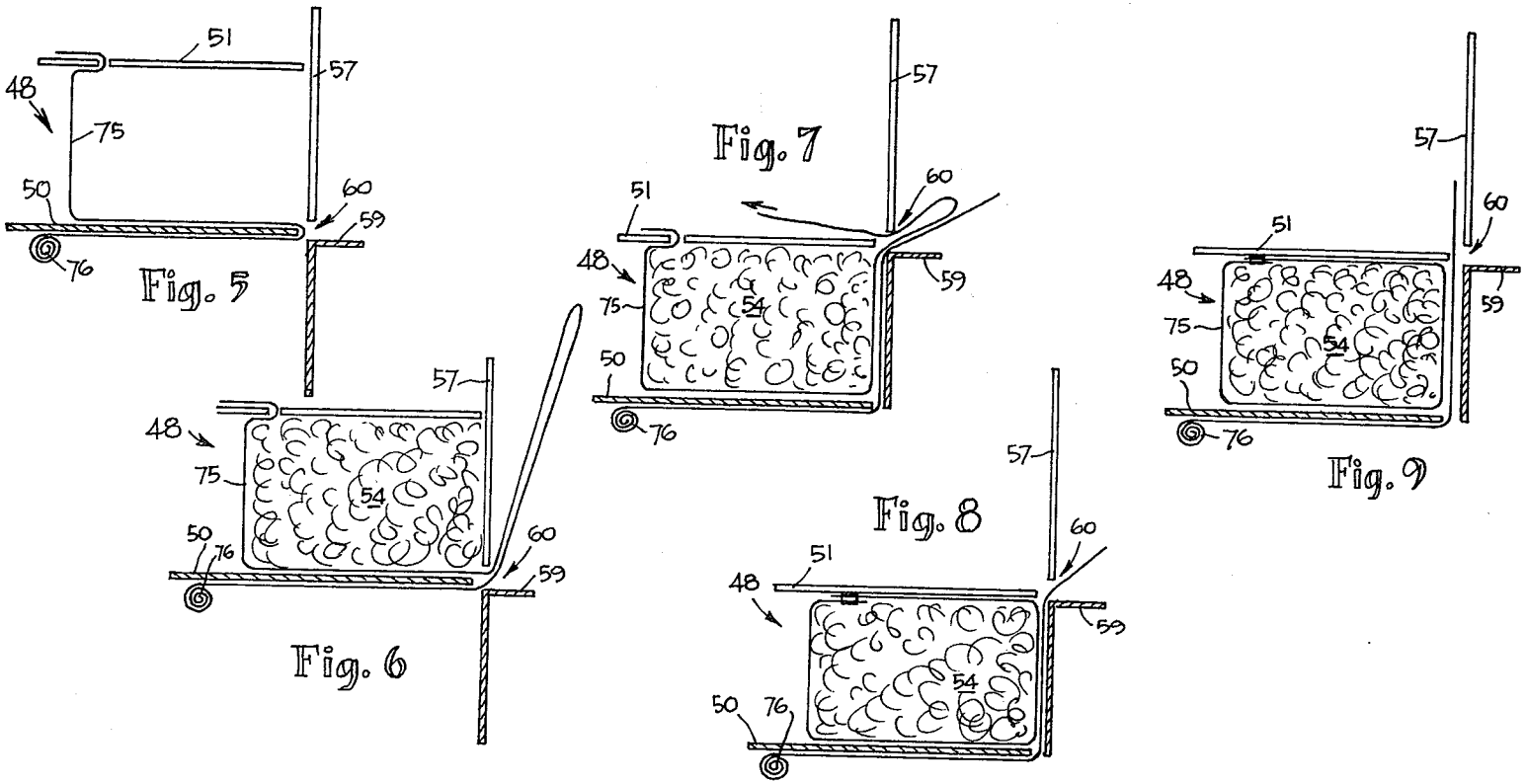
FIG. 5 is a diagrammatic section showing the manner in which bands (or wires) for surrounding a bale are first located in the arrangement of FIG. 4.
FIG. 6 shows a further stage in the application of bands to surround a bale.
FIG. 7 shows a still further stage in the application of bands to surround a bale.
FIG. 8 shows the final stage.
FIG. 9 illustrates the positioning of a band for a further bale which is about to be pressed.

The sequential movement of the pusher 65 towards and away from the mouth 60 is achieved by eccentrics 71 coupled to the pushers 65 by arms 72. All eccentrics are carried on a common driven shaft 73. As shown in FIG. 11, there are four pushers 65 thus coupled to respective eccentrics 71, and in order for power input to be minimal, the eccentrics are out of phase by 90° with one another. It will be obvious to those in the art that the eccentrics 71 may be replaced by cranks and the shaft 73 by a crankshaft, constituting a mechanical equivalent. Reference is now made to the tying of a bale which constitutes a problem requiring solution in this invention. When a bale is first to be formed, a plurality of bands 75 (four in this embodiment) are fed out from respective spools 76 carried beneath the lower wall 50, and through slots in the upper wall 51. After the first bale 54 has been formed in the receptacle 48, the receptacle 48 is raised and the bands 75 are passed outwardly through mouth 60 (or in the alternative through slots 58 in wall 57) to form the loop as illustrated in FIG. 6. The receptacle 48 is then lowered and the loop is passed through the mouth 60 (or through slots 58 as the case may be) over the bale 54 and tied to form loops which surround and thereby retain the bale as a coherent mass, without the need for a jute bag. After this has occurred, the cut portions of the bands 76 are again fed through the mouth 60 (or slots 58) as shown in FIG. 9, and formation of a further bale causes the band to be urged rearwardly until it finally occupies the position shown in FIG. 5 when the tying procedure is repeated.

The function of the upper wall 51 is to apply some pressure to the bales so that as wool is injected through the mouth 60, the bales are ejected rearwardly from the receptacle 48.

It has been shown that a relatively inexpensive press constructed in accordance with the third embodiment is capable of pressing wool to a density of about 40 lbs. per cubic foot.

We claim:

1. A wool press comprising walls which surround a bale-forming space and spaced apart surfaces which define between them a mouth to said space, the maximum mouth width in a direction perpendicular to said spaced apart surfaces being less than the maximum bale-forming space width between said walls measured along said direction, the maximum mouth width being sufficiently small that wool when in said space at superatmospheric pressure does not disgorge from the mouth, and wool injecting means comprising at least one pusher adjacent said mouth, and drive means coupled to said pusher effective to move it sequentially towards and away from said mouth so that wool fed between said pusher and said mouth is driven by said pusher through said mouth and into said bale-forming space upon movement of said pusher towards said mouth.

2. A wool press according to claim 1 further including a plurality of said pushers arranged side by side, and said drive means comprises an eccentric (or crank) shaft having thereon a corresponding plurality of radially spaced eccentrics (or cranks), and means connecting said eccentrics (or cranks) to respective said pushers to permit sequential pushing movement of said pushers upon rotation of said eccentrics (or cranks).

3. A wool press according to claim 1 further comprising tracks located one each side of said mouth defining surfaces, said walls forming portion of a bale-forming receptacle, wheels on the receptacle engaging said tracks to guide the receptacle for reciprocating movement in said direction perpendicular to a said mouth defining surface, and power operated means coupled to said receptacle and operable to effect said reciprocating movement.

4. A method of pressing wool into a bale in a wool press having walls which surround a bale-forming space, and spaced apart surfaces which define between them a mouth to said space, the maximum mouth width in a direction perpendicular to a said surface being less than the maximum bale space width between said walls in the same direction, the maximum mouth width being sufficiently small that wool when in said space at superatmospheric pressure does not disgorge from the mouth, the method comprising injecting wool through said mouth under high pressure into said space, discontinuing said wool injection when a bale has been formed therein, surrounding the bale with bale retaining means, and removing the bale from said space.

5. A method according to claim 4 further comprising feeding wool between a pair of co-operable rollers extending across said mouth and driving said rollers to thereby effect said wool injection at high pressure.

6. A method according to claim 4 further comprising feeding wool between said mouth and a pusher located adjacent said mouth, and driving said pusher towards said mouth to thereby effect said wool injection at high pressure.

7. A method according to claim 6 wherein said walls form portion of a bale-forming receptacle, the method further comprising moving the receptacle with a reciprocating movement in said direction perpendicular to a said mouth-defining surface so as to evenly distribute wool which is injected into said bale-forming space.

* * * * *